United States Patent [19]

Hopfensperger et al.

[11] Patent Number: 4,662,818

[45] Date of Patent: May 5, 1987

[54] TANGENTIAL BLOWER

[75] Inventors: Reinhold Hopfensperger, Dietelskirchen; Dieter Schmidt, Piflas, both of Fed. Rep. of Germany

[73] Assignee: International Standard Electric Corporation, New York, N.Y.

[21] Appl. No.: 819,472

[22] Filed: Jan. 15, 1986

Related U.S. Application Data

[63] Continuation of Ser. No. 631,140, Jul. 16, 1984, abandoned.

[30] Foreign Application Priority Data

Jul. 23, 1983 [DE] Fed. Rep. of Germany ..... 3326650

[51] Int. Cl.[4] ..... F04D 29/66

[52] U.S. Cl. ..... 415/119; 415/DIG. 1; 181/264

[58] Field of Search ..... 415/119, 53, 54, DIG. 1, 415/143, 211; 181/224, 264, 281

[56] References Cited

U.S. PATENT DOCUMENTS

| | | | |
|---|---|---|---|
| 1,787,655 | 1/1931 | Anderson | 415/DIG. 1 |
| 2,325,221 | 7/1943 | Bretzlaff et al. | 415/143 |
| 2,333,017 | 10/1943 | Leathers | 415/211 |
| 3,002,341 | 10/1961 | Muzzy et al. | 415/119 |
| 3,770,081 | 11/1973 | Martin | 181/264 |
| 3,779,341 | 12/1973 | Huggins | 181/264 |
| 3,832,085 | 8/1974 | DeFauw et al. | 415/DIG. 1 |
| 4,014,625 | 3/1977 | Yamamoto | 415/54 |
| 4,116,269 | 9/1978 | Ikeda | 181/224 |
| 4,152,094 | 5/1979 | Honda et al. | 415/DIG. 1 |

FOREIGN PATENT DOCUMENTS

| | | |
|---|---|---|
| 1503591 | 4/1978 | Fed. Rep. of Germany . |
| 2448362 | 1/1983 | Fed. Rep. of Germany . |

*Primary Examiner*—Robert E. Garrett
*Assistant Examiner*—John Kwon
*Attorney, Agent, or Firm*—T. L. Peterson

[57] ABSTRACT

In a tangential blower having side walls near the air outlet provided with lugs projecting into the high pressure chamber.

8 Claims, 9 Drawing Figures

AIR OUTPUT SIDE

ROTOR SIDE

TANGENTIAL BLOWER

This is a continuation of application Ser. No. 631,140 filed 7/16/84, abandoned.

BACKGROUND OF THE INVENTION

This invention relates to a tangential blower (cross-flow fan) of a small size and more particularly to a blower housing having side walls completely or partly enclosing the rotor ends.

PRIOR ART STATEMENT

The phrase "small size" refers to such tangential blowers whose rotors, for example, have diameters ranging between 40 and 60 mm.

Such tangential blowers are used in large numbers, e.g., in household appliances, fan heaters, air conditioning equipment, convectors, copying machines, projectors, plug-in units for electrical and electronic equipment and the like.

It has turned out that if the known small size tangential blowers are operated with free air output or little throttling, the speed of the discharging air in the edge zones near the end disks is much smaller than that in the inner zone of the blowers. In the areas where the side walls meet the baffle plate, even negative speeds of the discharging air may occur, i.e., a backward airstream may occur in the pressure connection. This means, however, that the blower does not reach the optimum delivery figure.

It is known (German Published Patent Application No. 15 03 591) that these deficiencies can be remedied by constructing the rotor end disks and/or the side walls of the housing. The known solutions are all based upon the same principle, namely to provide openings in the side walls at the rotor ends and/or in the rotor end disks in order to supply more air to the edge zones of the rotor. However, this known solution is only suitable for special applications because, despite a higher optimum delivery figure, pressure losses are likely to occur in the higher throttling range. The amount of these losses depends upon the blower geometry as well as on the location and the shape of the openings. Moreover, a higher noise level is noticed.

In another conventional solution (German Pat. No. 24 48 362) the backstreaming in the edge zones near the end disks is avoided. In the edge zones near the end disks, deflecting surfaces having a given width and provided with break-away edges are disposed on the inner surface of the baffle plate.

This conventional solution has already resulted in an essential improvement in most cases of practical application. In other cases of practical application, however, this conventional measure cannot prevent most of the edge-zone stream from the high pressure chamber from being sucked back into the rotor. A loud singing noise (whistling) is also produced. This phenomenon occurs chiefly in the case of a small counter pressure. It occurs at a slight throttling of the tangential blower, as well as with tangential blowers of high specific efficiency.

SUMMARY OF THE INVENTION

In accordance with the blower of the present invention, there are provided lugs which improve the edge-zone streaming and, at the same time, the singing noise of the tangential blower. Both of these problems are either completely avoided or at least reduced to a considerable extent, without any additional noise occurring in other operational areas of the blower.

BRIEF DESCRIPTION OF THE DRAWINGS

In the accompanying drawings which illustrate exemplary embodiments of the present invention.

Figure 3:
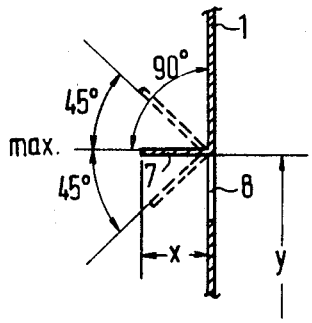

FIGS. *2a–2f* are a side elevational view of alternative lugs of the invention;

FIG. 3 is a sectional view through a lug; and

Figure 4:
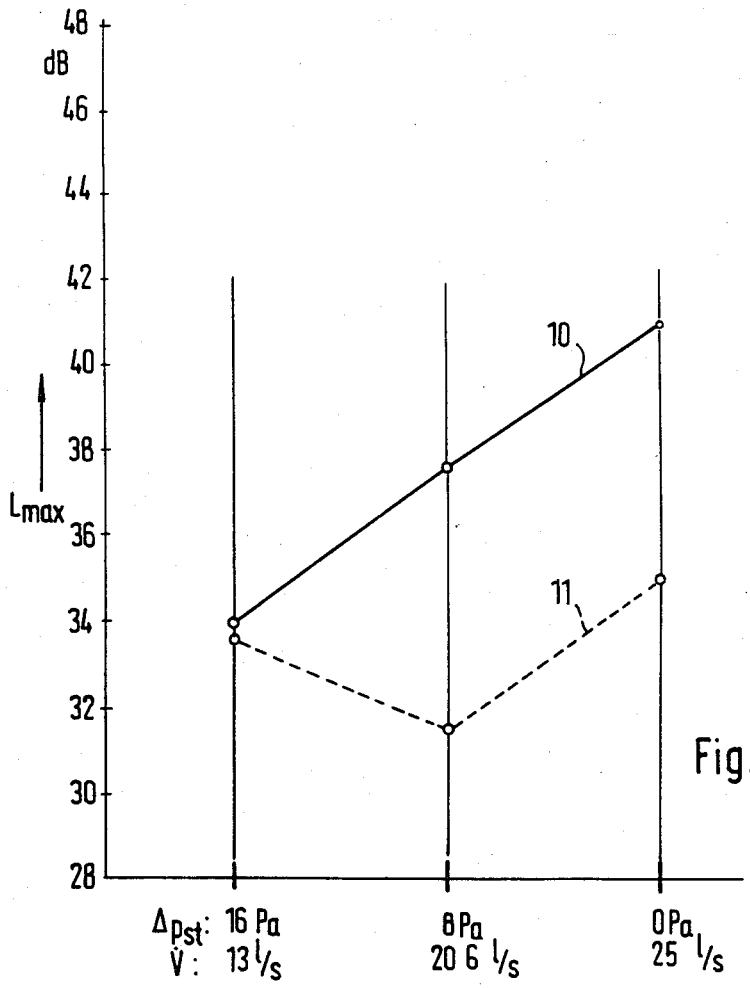

FIG. 4 is a diagram illustrating the evaluated sound pressure level at various operating points relating to both a conventional and the novel tangential blower.

Figure 1:
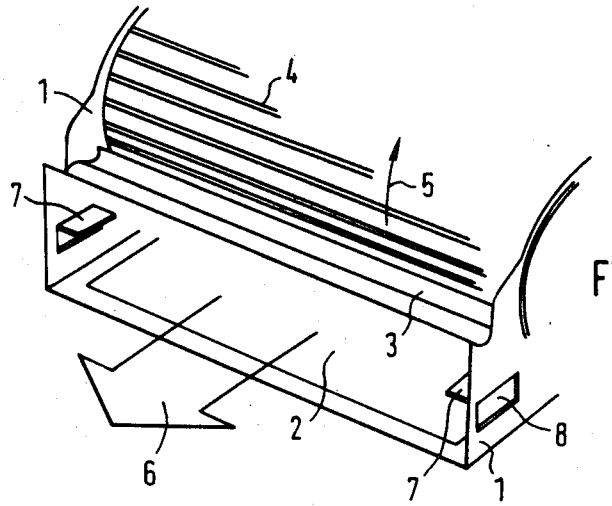
FIG. 1 is a perspective view of a tangential blower constructed in accordance with the present invention.
Figure 2A:
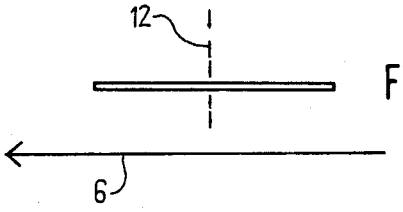
Figure 2B:
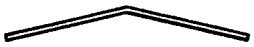
Figure 2C:
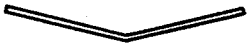
Figure 2D:
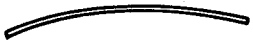
Figure 2E:
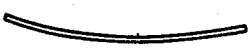
Figure 2F:
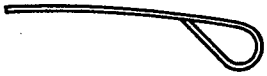

As can be seen from FIG. 1, the tangential blower comprises a housing including side walls 1, a baffle plate 2 and a vortex former 3. A rotor 4 is rotatably supported and, during operation, is driven in the direction indicated by an arrow 5. At the front end, the side walls 1, the baffle plate 2 and the vortex former 3 form an almost rectangular air outlet opening through which air is to be conveyed as uniformly as possible in the direction indicated by an arrow 6. In order to safeguard or to assist this, the side walls 1, according to the invention, are provided with lugs 7. In the given example, the lugs 7 have been produced by having been punched out of the side walls on three different sides, and by having been bent backwards. It can be seen that the space immediately around the lugs is substantially free of obstruction to the flow of air in the direction of arrow 6.

FIG. 2 shows six other and different embodiments of a lug. The lug as shown in FIG. *2a* is flat. In distinction thereto, the lugs as shown in FIGS. *2b* and *2c* are bent, with the bend being directed either upwardly or downwardly. In FIGS. *2d* and *2e*, the lugs are shown to have a curved shape, with the curvature extending either in the upward or in the downward direction. FIG. *2f* shows a further embodiment of the lug which may be used with all types of embodiments, namely, with a rounded portion 9 at the end of the lug facing the rotor. As shown in FIG. 1, the lugs are of generally plate-like shape and are oriented so an imaginary line 12 (FIG. *2a*) extending normal to the surface of the plate-like shape is substantially perpendicular to the direction of air flow indicated by arrow 6.

FIG. 3 illustrates both the position and the arrangement of the lug 7 in the side wall 1. The length of the lug 7 is indicated by x and the spacing of the base of the lug 7 from the baffle plate is indicated by y. The lug 7 may be disposed normal to the side wall 1 or else, as is indicated by the dashlined positions in FIG. 3, may deviate therefrom to ±45 angular degrees.

FIG. 4 shows the maximum sound pressure level L max in dependence upon the operating point with respect to a conventional tangential blower (characteristic 10) and with respect to a tangential blower employing the lugs 7 according to the invention (characteristic 11). From the characteristic 11 it can be recognized that with the tangential blower according to the invention, especially in the case of a free air output or in the case of a small to medium throttling, the maximum sound pressure level is very much lower compared to that of the conventional type of the tangential blower.

What is claimed is:

1. A tangential blower comprising a housing; a rotor rotatable in said housing and thereby having an axis of rotation, and blades with edges extending parallel to said axis of rotation; a spiral-shaped baffle plate mounted in said housing and passing, in a region of high pressure, from a spiral shape into a plane, curved or stepped surface; means defining an air outlet for directing air generally in a predetermined downstream direction, said air outlet being of largely rectangular shape with a first pair of opposite walls spaced apart by a greater distance than a second pair of opposite walls; said first pair of walls being provided with lugs located downstream from said rotor and projecting from said first walls into said high pressure region and being spaced from said second walls, said lugs being of generally plate-like shape with opposite surfaces and mounted so that an imaginary line normal to said lug surfaces is substantially perpendicular to the direction of air flow, the space immediately around said lug surfaces being substantially free of obstruction to the flow of air in said predetermined direction wherein said lugs are punched out of said side walls and are bent back to leave an opening into the environment outside the outlet.

2. A tangential blower as claimed in claim 1, wherein said lugs are flat.

3. A tangential blower as claimed in claim 1, wherein said lugs are bent.

4. A tangential blower as claimed in claim 1, wherein said lugs are curved.

5. A tangential blower as claimed in claim 1, wherein said lugs at their ends facing the rotor are provided with a rounded portion.

6. A transverse blower as claimed in claim 1, wherein said lugs are disposed at right angles in relation to said side walls.

7. A tangential blower as claimed in claim 1, wherein each lug has a length between about 0.05 to 0.25 times the length of said rotor.

8. A tangential blower as claimed in claim 1, wherein the spacing of each lug from said baffle plate ranges between about 0.2 to 0.7 times the height of said air outlet, and the space between each lug and said baffle plate is free of obstruction.

* * * * *